US005570941A

United States Patent [19]

R̈ock et al.

[11] Patent Number: 5,570,941

[45] Date of Patent: Nov. 5, 1996

[54] SUPPORTING RAIL FITTING OR ASSEMBLY FOR DRAWER

[75] Inventors: Erich Röck, Höchst, Austria; Fredi Dubach, Adetswil, Switzerland

[73] Assignee: Julius Blum Gesellschaft m.b.H., Höchst, Austria

[21] Appl. No.: 392,506

[22] Filed: Feb. 23, 1995

[30] Foreign Application Priority Data

Feb. 25, 1994 [AT] Austria ..... A369/94

[51] Int. Cl.[6] ..... A47B 88/04

[52] U.S. Cl. ..... 312/334.6; 312/330.1; 312/334.1; 312/334.7

[58] Field of Search ..... 312/334.6, 334.1, 312/334.7, 334.8, 334.13, 334.22, 334.24, 334.32, 330.1

[56] References Cited

U.S. PATENT DOCUMENTS

| | | | |
|---|---|---|---|
| 2,215,881 | 9/1940 | Levensten | 312/334.7 X |
| 2,559,237 | 7/1951 | Waller | 312/334.7 X |
| 2,572,081 | 10/1951 | Wallance | 312/334.7 X |
| 2,822,231 | 2/1958 | Golz et al. | 312/334.6 |
| 4,090,753 | 5/1978 | Röck et al. | 312/330.1 X |
| 4,199,200 | 4/1980 | Livingston . | |
| 4,438,994 | 3/1984 | Davis . | |
| 4,681,381 | 7/1987 | Sevey . | |
| 5,310,255 | 5/1994 | Ranallo | 312/334.1 X |
| 5,344,227 | 9/1994 | Röck et al. | 312/334.6 |

FOREIGN PATENT DOCUMENTS

| | | | |
|---|---|---|---|
| 560076 | 9/1993 | European Pat. Off. | 312/334.13 |
| 843463 | 5/1952 | Germany . | |
| 4032426 | 4/1992 | Germany | 312/334.1 |

*Primary Examiner*—Peter M. Cuomo
*Assistant Examiner*—Rodney B. White
*Attorney, Agent, or Firm*—Wenderoth, Lind & Ponack

[57] ABSTRACT

A supporting rail fitting for a drawer pull-out guide for frame furniture having at least one vertical and one horizontal frame member. The supporting rail is secured to the frame at the front. A mounting plat capable of being secured to the vertical frame member and having a securing web is provided. Securing means, such as screws, project through the securing web. The mounting plate has at least one stop web which extends at right angles to the securing web and in the mounted state lies laterally against the frame member. Further, the mounting plate is provided with an anchoring web which protrudes from the frame member and to which the supporting rail can be coupled.

17 Claims, 5 Drawing Sheets

SUPPORTING RAIL FITTING OR ASSEMBLY FOR DRAWER

BACKGROUND OF THE INVENTION

The invention relates to a supporting rail fitting for a drawer pull-out guide for frame furniture having a front frame with vertical and horizontal frame member, the supporting rail being secured to the frame at its front end. In furniture making, cabinets are known in which the furniture carcass is provided, at the front, with a frame which carries the fittings of the piece of furniture. To this frame are secured the hinges for a furniture door as well as the supporting rails of a pull-out guide assembly for the drawers.

SUMMARY OF THE INVENTION

The object of the invention is to improve the mounting of the drawer pull-out guide in a piece of frame furniture of this type. At the same time, it should be possible for the customer to be able to choose, in the case of the drawer pull-out guides, between various alternative forms, such as a pull-out arrangement having single extension, a pull-out arrangement having full extension, pull-out arrangements having running rollers mounted on rails and pull-out arrangements having running carriages, and to mount these on the frame in a simple way.

The object according to the invention is achieved by a mounting plate capable of being secured to the vertical frame member and having a securing web through which securing means, such as screws, project and at least one stop web which extends at right angles to the securing web and in the mounted state lies laterally against the vertical frame member, as well as an anchoring web which protrudes from the vertical frame member and to which the supporting rail can be coupled.

Figure 1:
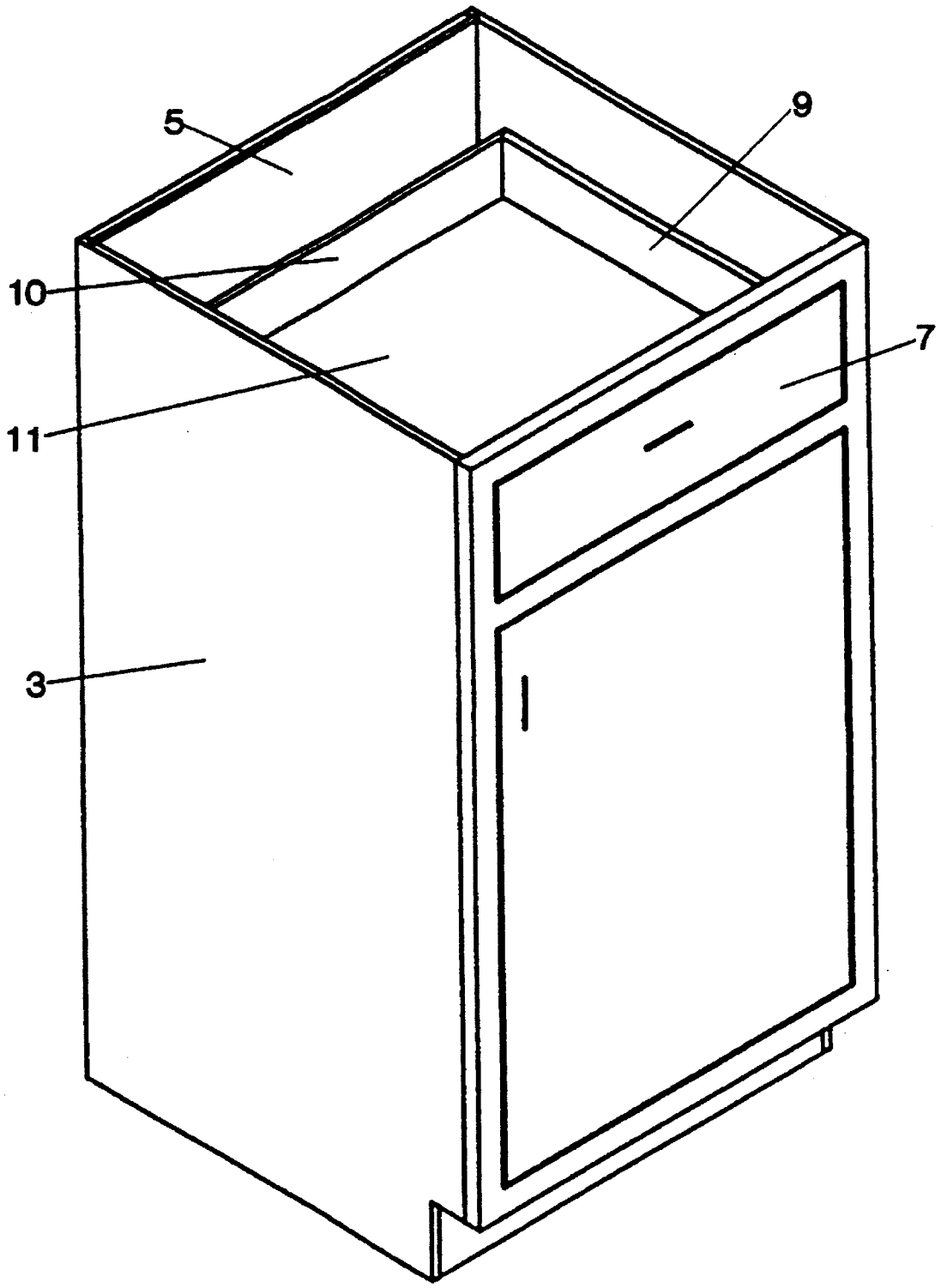
FIG. 1 shows a schematic diagram of a piece of frame furniture.
Figure 2:
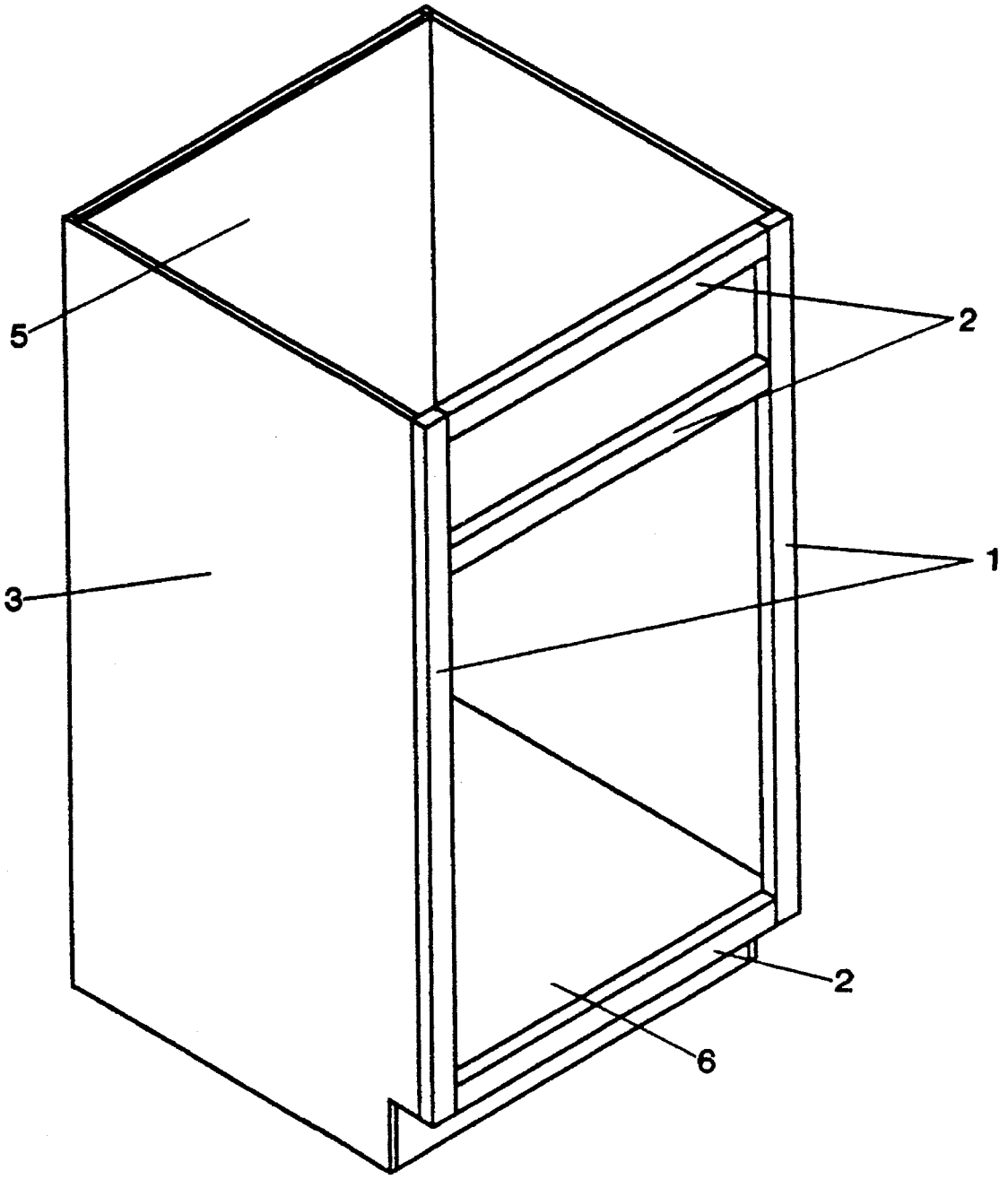
FIG. 2 shows a schematic diagram of the carcass of a piece of frame furniture.
Figure 3:
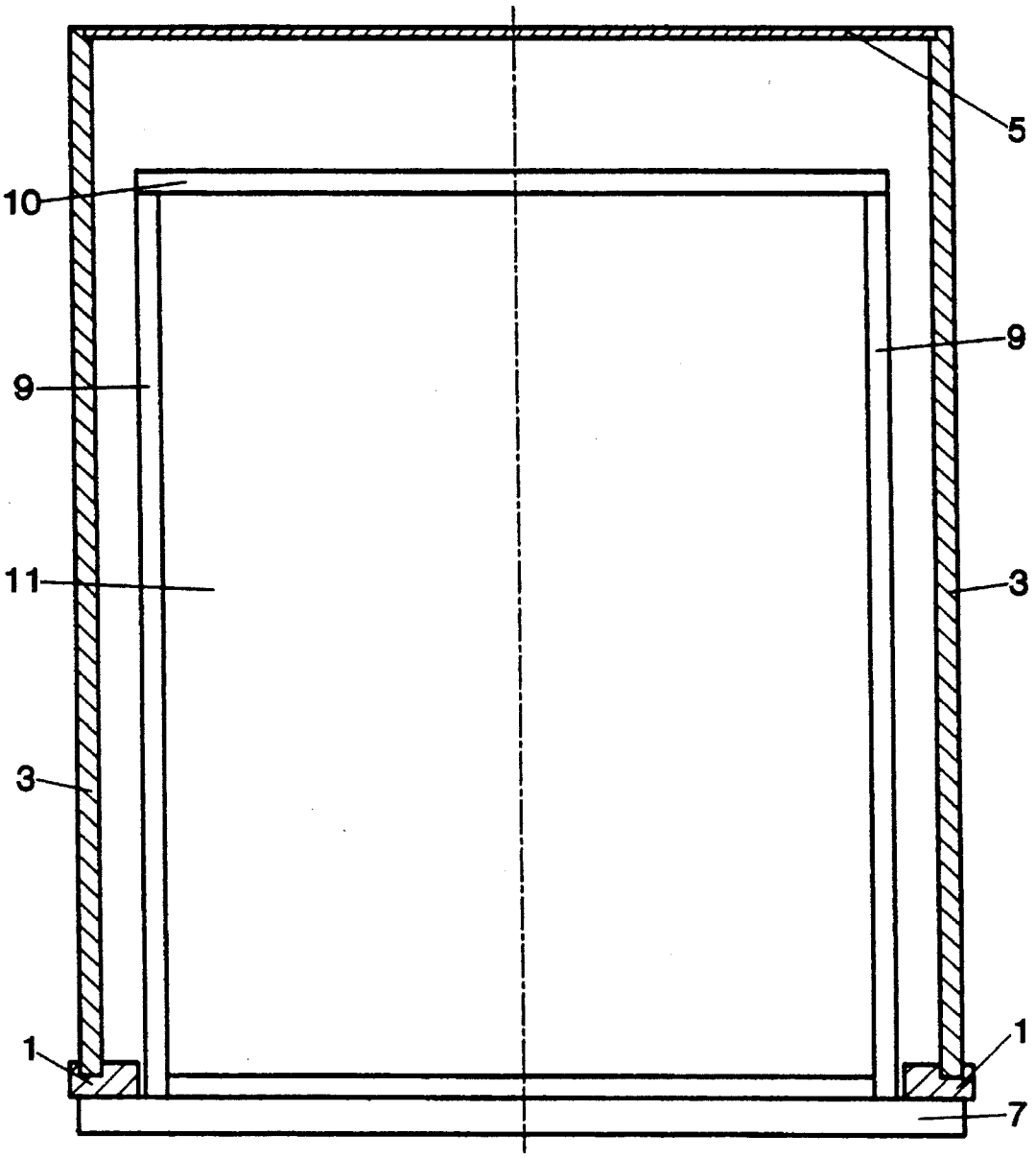
FIG. 3 shows a horizontal section through a piece of frame furniture above a drawer and FIG. 4 and 5 show a disassembled diagram of two exemplary embodiments of the supporting rail fitting according to the invention.

The furniture carcass has two side walls 3, a rear wall 5 and a base 6.

At the front, the side walls 3 are covered by a vertical frame member 1. In the exemplary embodiment shown, a horizontal frame member 2 is provided above and below the drawer respectively.

The drawer has, in the conventional way, two drawer side members 9, a front panel 7, a drawer base 11 and a rear wall 10.

Arranged on each of the side (sic) of the drawer is a pull-out rail by means of which the drawer is movable relative to the supporting rails 12 secured to the furniture carcass.

The supporting rails 12 secured to the frame have a vertical web 29 from which angled-off tabs 13 and straight projections 14 are punched out at the front.

Each supporting rail 12 is hung into the vertical anchoring web 20 of a mounting plate 15. The mounting plate 15 has a securing web 16 through which securing means 17, such as screws, project, thus securing the mounting plate 15 to the frame member 1. On both sides of the securing web 16, the mounting plate 15 has two stop webs 18 which extend at right angles to the securing web 16 and by means of which it embraces the frame member 1 in a U-shape. As a result, the mounting plate 15 is held on the frame member 1 in a manner secure against tilting and is also able to transmit greater moments, i.e. take up greater drawer loads.

The anchoring web 20 protrudes from the inner stop web 18 and projects into the furniture carcass. Two slots 21 are located in the anchoring web 20.

On assembly of the piece of furniture, firstly the mounting plate 15 is screwed to the furniture frame, i.e. to the frame member 1. After choosing the desired pull-out guide, the supporting rail 12 is hung into the anchoring web 20, during which process the angled-off tabs 13 project through the slots 21. Whereas the angled-off tabs 13 lie against the anchoring web 20 from behind, the projections 14 lie against the front side of the anchoring web 20. The interlocking ensures a secure anchoring of the supporting rail 12 on the mounting plate 15.

Figure 4:
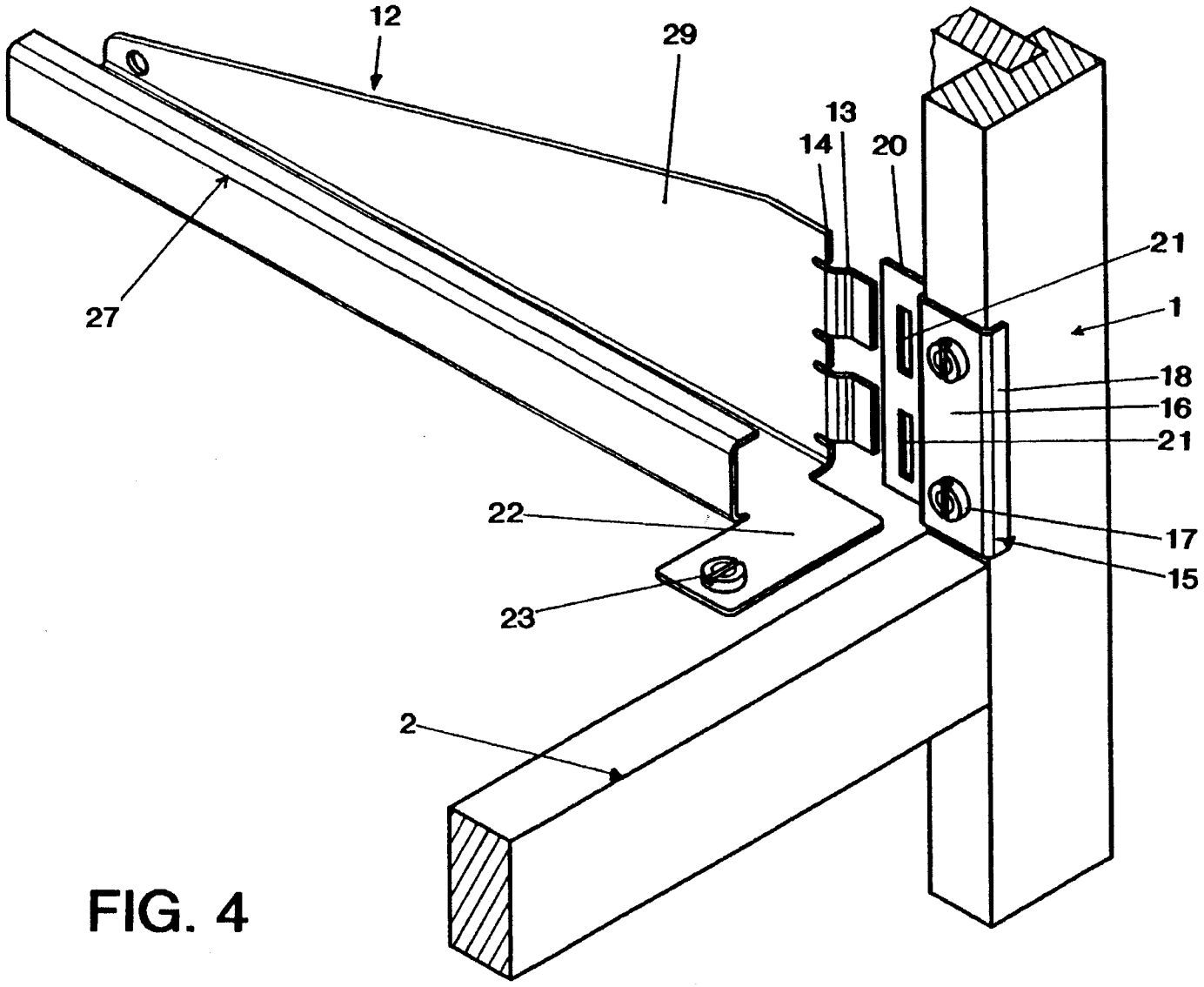

In the exemplary embodiment according to FIG. 4, the supporting rail 12 has a horizontal web 22 at the bottom. By means of a screw which projects through a hole 23 in the web 22, the supporting rail 12 is also secured to one of the horizontal frame strip 2 lying thereunder (sic).

Figure 5:
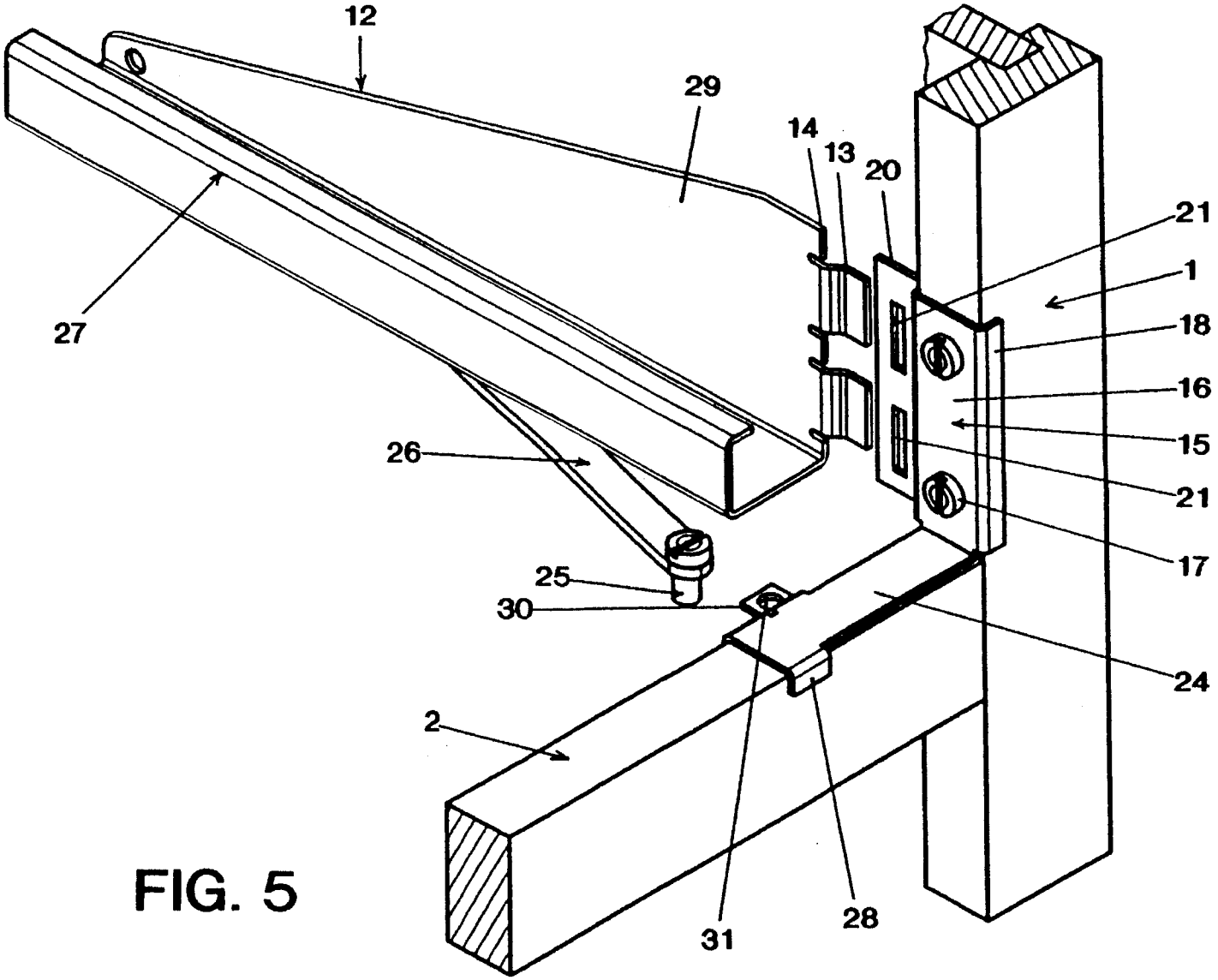

In the exemplary embodiment of FIG. 5, the mounting plate 15 is provided with a horizontal web 24 at the bottom. The horizontal web 24 lies, in the mounted state, on the lower horizontal frame strip 2 and tightly embraces the latter with its edge webs 28, with the result that the stability of the anchoring for the supporting rail 12 is improved.

A tab 30 having a punched hole 31 protrudes from the horizontal web 4.

Secured approximately in the middle of the supporting rail 12 is a strut 26 which projects obliquely forwards and which carries an eccentric bolt 25 at the front. This eccentric bolt 25 can be hung into the hole 31 of the tab 30, which form a securing eye for the strut 26. By turning the eccentric bolt 25, the orientation of the supporting rail 12 can be adjusted or the latter can be tilted with respect to the anchoring plate 20 and thus braced.

In the exemplary embodiments shown, a supporting rail 12 having a running web 27 is shown, which is suitable for receiving carriages having rollers or balls. In the same way, supporting rails 12 having any desired rail profile, or supporting rails 12 supporting only rollers, and also rails of different length can be quickly mounted on the furniture.

We claim:

1. A supporting rail assembly to be employed in a drawer pull-out guide to enable movement of a drawer into and out of an article of furniture including a front frame, said assembly comprising:

a mounting plate to be secured to a vertical frame member of the front frame, said mounting plate including a securing web through which is to extend at least one securing device, at least one stop web extending from said securing web at a right angle thereto in a direction to abut the vertical frame, and an anchoring web integral with said securing web and extending in a direction to be rearwardly of the vertical frame member;

a supporting rail having a front end connectable to said anchoring web.

2. An assembly as claimed in claim 1, wherein said mounting plate includes two stop webs extending at right angles from spaced edges of said securing web, such that said mounting plate has a U-shaped configuration to embrace the vertical frame member.

3. An assembly as claimed in claim 1, wherein said securing web and said anchoring web extend in parallel planes.

4. An assembly as claimed in claim 1, wherein said securing web and said anchoring web extend in opposite directions from said stop web.

5. An assembly as claimed in claim 4, wherein said securing web and said anchoring web extend in parallel planes.

6. An assembly as claimed in claim 1, wherein said anchoring web is oriented to extend vertically when said mounting plate is in a mounted position, and said supporting rail includes a vertical web having a front end that can be connected to said anchoring web.

7. An assembly as claimed in claim 6, wherein said anchoring web has therein slots, and said front end of said vertical web has bent tabs that are insertable into said slots.

8. An assembly as claimed in claim 7, wherein said front end of said vertical web further has straight projections.

9. An assembly as claimed in claim 8, wherein said bent tabs and said straight projections are dimensioned such that, when said bent tabs are inserted into said slots, said bent tabs lie against one side of said anchoring web and said straight projections lie against an opposite side of said anchoring web.

10. An assembly as claimed in claim 1, wherein said front end of said supporting rail has extending therefrom a horizontal web to be secured to a horizontal frame member of the front frame.

11. An assembly as claimed in claim 10, wherein said horizontal web has therethrough a hole.

12. An assembly as claimed in claim 1, wherein said mounting plate further includes a horizontal web to be mounted on a horizontal frame member of the front frame.

13. An assembly as claimed in claim 12, wherein said horizontal web has two edge webs extending from spaced edges of said horizontal web, such that said horizontal web has a U-shaped configuration to embrace the horizontal frame member.

14. An assembly as claimed in claim 12, wherein said horizontal web has a securing eye.

15. An assembly as claimed in claim 14, wherein said securing eye comprises a hole formed in a tab extending from said horizontal web.

16. An assembly as claimed in claim 14, further comprising a strut protruding from said supporting rail and having an end supported at said securing eye.

17. An assembly as claimed in claim 16, further comprising an eccentric bolt mounted at said end of said strut and insertable into said securing eye.

* * * * *

UNITED STATES PATENT AND TRADEMARK OFFICE

CERTIFICATE OF CORRECTION

PATENT NO. : 5,570,941

DATED : November 5, 1996

INVENTOR(S) : Erich Rock, et. al.

It is certified that error appears in the above-indentified patent and that said Letters Patent is hereby corrected as shown below:

Title page, item [30], under Foreign Application Priority Data should read-- Feb. 25, 1994 [AT] Austria..... A 396/94--.

Signed and Sealed this

Eighteenth Day of February, 1997

*Attest:*

Bruce Lehman

BRUCE LEHMAN

*Attesting Officer*

*Commissioner of Patents and Trademarks*